US005298223A

United States Patent [19]

Berger et al.

[11] Patent Number: 5,298,223

[45] Date of Patent: Mar. 29, 1994

[54] IONIZATION FIRE DETECTOR

[75] Inventors: Horst Berger, Kaarst; Michael Pastors, Neuss; Mario Pussin, Mönchengladbach; Heiner Politze, Neuss; Georg Pollmann, Willich, all of Fed. Rep. of Germany

[73] Assignee: Esser Sicherheitstechnik GmbH, Fed. Rep. of Germany

[21] Appl. No.: 104,997

[22] Filed: Aug. 10, 1993

Related U.S. Application Data

[63] Continuation of Ser. No. 931,262, Aug. 17, 1992, abandoned.

[51] Int. Cl.[5] ..... G08B 21/00

[52] U.S. Cl. ..... 422/54; 73/31.05; 340/629

[58] Field of Search ..... 340/628, 629, 632, 636, 340/691; 436/55, 138; 73/25.03, 25.05, 31.01, 31.08; 422/54, 50

[56] References Cited

U.S. PATENT DOCUMENTS

| | | | |
|---|---|---|---|
| 3,676,680 | 7/1972 | Scheidweiler et al. | 340/629 |
| 3,909,815 | 9/1975 | Gacogne | 340/629 |
| 3,963,929 | 6/1976 | Beyersdorf | 340/629 |
| 3,964,036 | 6/1976 | Adachi et al. | 340/629 |
| 4,027,165 | 5/1977 | Jacobs | 340/629 |
| 4,041,479 | 8/1977 | Miyabe | 340/629 |
| 4,109,240 | 8/1978 | Scheidweiler | 340/629 |
| 4,150,373 | 4/1979 | Ried, Jr. | 340/629 |
| 4,383,253 | 5/1983 | Lam et al. | 340/629 |
| 4,394,079 | 7/1983 | Takematsu | 354/413 |
| 4,934,367 | 6/1990 | Daglow et al. | 439/86 |

FOREIGN PATENT DOCUMENTS

| | | | |
|---|---|---|---|
| 91623 | 10/1983 | European Pat. Off. | 340/629 |
| 217100 | 4/1987 | European Pat. Off. | 340/629 |
| 2713280 | 9/1978 | Fed. Rep. of Germany | 340/629 |
| 3311651 | 10/1984 | Fed. Rep. of Germany | 439/86 |
| 886024 | 11/1981 | U.S.S.R. | 340/629 |
| 2240214 | 7/1991 | United Kingdom | 340/629 |

OTHER PUBLICATIONS

Peter et al; "Shielded Connectors"; IBM Tech. Bull. Discl. vol. 22(2) pp. 523-524; Aug./Jul. 1979.

Miller et al; "Solderless electrical Contactors"; IBM Tech Bull. Discl. vol. 7(1), pp. 101-102; Jun. 1964.

*Primary Examiner*—James C. Housel
*Assistant Examiner*—Ramon Torres
*Attorney, Agent, or Firm*—Feiereisen & Kueffner

[57] ABSTRACT

An ionization fire detector of the type including a measuring chamber and a reference chamber having a common electrode which is connected to the gate terminal of a field-effect transistor by a profile piece of conductive caoutchouc having one end contacting the gate terminal and another end contacting the common electrode.

6 Claims, 2 Drawing Sheets

IONIZATION FIRE DETECTOR

This is a continuation of application Ser. No. 07/931,262, filed Aug. 17, 1992, now abandoned.

BACKGROUND OF THE INVENTION

The present invention refers to an ionization fire detector, and in particular to an ionization fire detector of the type including a measuring chamber and a reference chamber having a common electrode which is connected to the gate terminal of a field-effect transistor (FET).

Ionization fire detectors of this type are generally known. The common electrode of the measuring chamber and the reference chamber is mounted within or to an insulation carrier which ensures sufficiently high insulation resistance over a long operational period regardless of contaminations which are inevitably experienced in the course of time. The gate terminal of the field-effect transistor is usually welded, riveted or clamped to the common electrode. Since field-effect transistors are sensitive to static charges and have only limited available space, great care is required to connect the gate terminal to the electrode. Moreover, it must be ensured that the high insulation resistance will not be adversely affected through the connection process.

SUMMARY OF THE INVENTION

It is thus an object of the present invention to provide an improved ionization fire detector obviating the afore-stated drawbacks.

In particular, it is an object of the present invention to provide an improved ionization fire detector in which contacting of the gate terminal of the FET with the common electrode of the measuring chamber and reference chamber is simplified and thus less time consuming and yet is reliable in operation.

These objects and others, which will become apparent hereinafter, are attained in accordance with the present invention by providing a profile piece of conductive caoutchouc for connection of the gate terminal with the common electrode.

Since the contact between the gate terminal and the electrode is attained without requirement of any tools, previously experienced drawbacks are eliminated. Moreover, there is no requirement to connect the FET with the electrode in the so-called control area. The profile piece of conductive caoutchouc can be dimensioned such as to act as high resistance series resistor. In connection with unavoidable line capacitances or other capacitances a low-pass filter is thus obtained. This low-pass effect across the gate terminal of the FET, i.e. at its input, is desired since the FET responds only to slow modifications of the voltage of the common electrode but not to momentary voltage shifts caused by interfering signals.

According to another feature of the present invention, the ionization fire detector includes an insulation carrier which supports the common electrode and is provided with a cavity separated by a respective wall section of the insulation carrier from the electrode to accommodate the FET, with the profile piece being inserted through a respective opening in the wall section of the insulation carrier. In this manner, the profile piece ensures a sealing of the cavity against the common electrode so that the cavity can easily be cast with insulating plastic material without risk of injected plastic material reaching the electrode. The electrode is thus insulated from the gate terminal of the FET so that deterioration of the insulation through contamination during use of the fire detector can be avoided.

Preferably, the gate terminal is simply pierced or pushed into the profile piece. This is especially advantageous when the profile piece is of square or rectangular cross-section and the gate terminal extends perpendicular to the longitudinal axis of the profile piece. Alternatively, the gate terminal may also be clamped to the perimeter of one end of the profile piece. This is especially advantageous if the gate terminal extends coaxial to the profile piece, in which case the profile piece may be of circular cross-section.

For contact with the common electrode, the profile piece may be suitably elastically pressed onto the electrode, or the electrode may have a recess, with the profile piece being tightly fitted therein. In both cases, the profile piece assumes the function of a mechanical, elastic support and/or fixation of the electrode in the insulation carrier.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 2:
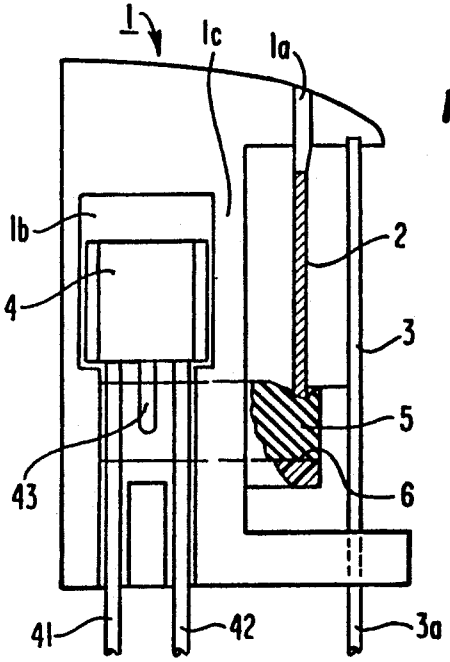
FIG. 2 is a side view of the insulation carrier of FIG. 1.

Throughout all the Figures, the same or corresponding elements are always indicated by the same reference numerals.

Figure 1:
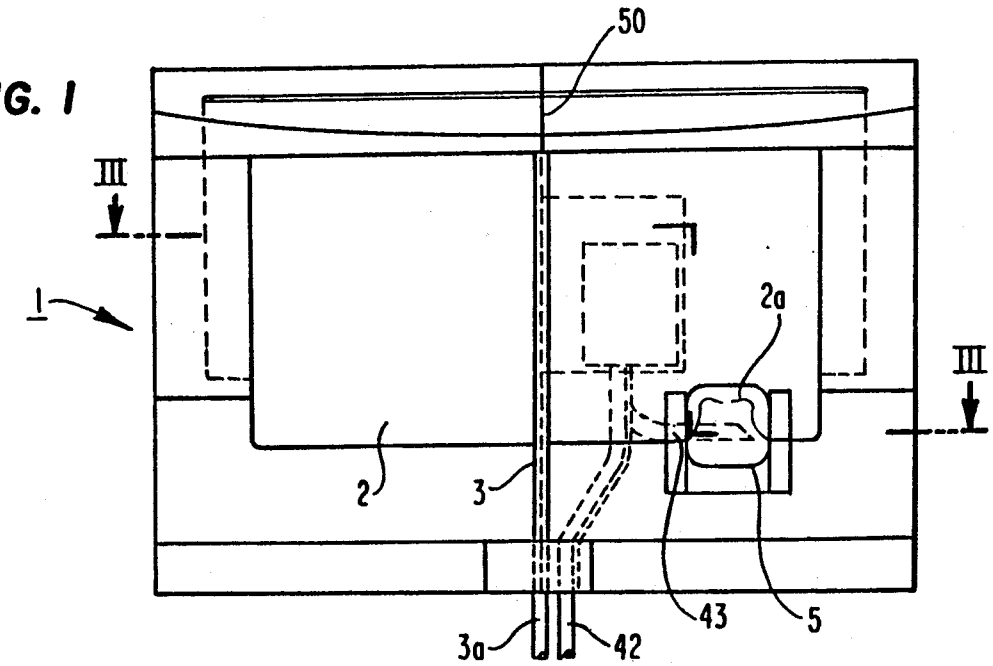
FIG. 1 is a frontal view of an ionization fire detector according to the invention, illustrating in detail one embodiment of an insulation carrier including an arrangement of electrode and field-effect transistor.
Figure 3:
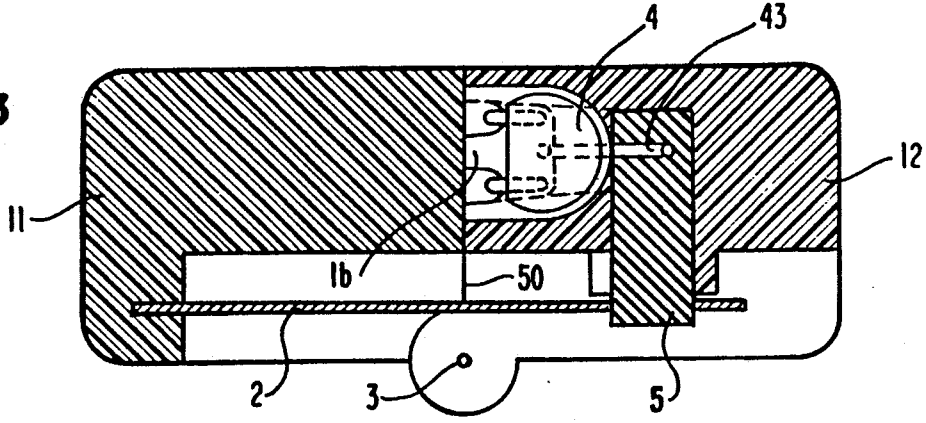
FIG. 3 is a sectional view of the insulation carrier of FIG. 1 taken along the line III—III in FIG. 1.

Referring now to the drawings and in particular to FIGS. 1-3, there is shown one embodiment of an ionization fire detector having an insulation carrier generally designated by reference numeral 1 and made of suitable plastic material. The insulation carrier 1 supports a flat electrode 2 which is inserted from above through a slot la in the insulation carrier 1 and suitably secured therein. The electrode 2 which may also form the support for a not shown ionizing preparation constitutes the common electrode of the measuring chamber and the reference chamber of the ionization fire detector. The general structure of an ionization fire detector and its mode of operation are generally known by persons skilled in the art and thus a detailed description thereof is omitted.

As shown in FIG. 2, the insulation carrier 1 is of generally U-shaped configuration, with the mating or counterelectrode 3 of the reference chamber extending between the shanks of the U and being suitably secured in the insulation carrier 1. The lower end of the counter-electrode 3 traverses the base shank of the insulation carrier 1 and has a terminal 3*a* which is adapted for connection with a not shown electronic evaluation unit.

Arranged at the backside of the insulation carrier 1 and separated from the electrode 2 by a respective wall section 1*c* is a cavity or chamber 1*b* which accommodates a field-effect transistor (FET) 4, with its drain terminal 41 and source terminal 42 being led through the insulation carrier 1 for connection to the evaluation unit. In order to allow installation of the field-effect transistor 4 in cavity 1*b*, the insulation carrier 1 is divided along a line 50 in two halves 11 and 12 as shown in particular in FIGS. 1 and 3.

At a suitable location, the wall section 1*c* of the insulation carrier 1 is provided with a bore 6 for insertion of a profile piece 5 from the outside and for secure placement in an essentially complementary chamber of same cross-section between the cavity 1*b* and the lower edge of the electrode 2. The profile piece 5 which is of generally rectangular cross-section and made of conductive caoutchouc provides a connection of the gate terminal 43 of the FET 4 with the electrode 2. As shown in particular in FIGS. 1 and 3, the gate terminal 43 is bent along a curved path to extend perpendicular to the longitudinal axis of the profile piece 5 so that contact with the profile piece 5 is attained by simply piercing or pushing the gate terminal 43 into the respective end of the profile piece 5. For providing contact with the electrode 2, the latter is provided with an approximately U-shaped recess 2*a* to define three edges or areas which upon insertion of the electrode 2 through the slot 1*a* cut into the other end of the conductive caoutchouc material of the profile piece 5.

By selecting a conductive caoutchouc of respective specific conductivity and by suitably dimensioning its length and cross-section, the profile piece 5 can be designed as a series resistor of a low-pass filter between the electrode 2 and the FET 4. The transverse capacitance of this low-pass filter may be adjusted to the desired value through other known measures.

An ionization fire detector with an insulation carrier 1 according to the present invention allows installation of the field-effect transistor 4 in the cavity 1*b* without necessitating use of any tools for attaining a contact with the electrode 2. After installation of the FET 4 and contacting the gate terminal 43 and the electrode 2 with the profile piece 5 in a manner as set forth above, insulating plastic material can be injected into the cavity 1*b* so that the halves 11 and 12 of the insulation carrier 1 are securely joined together.

Figure 5:
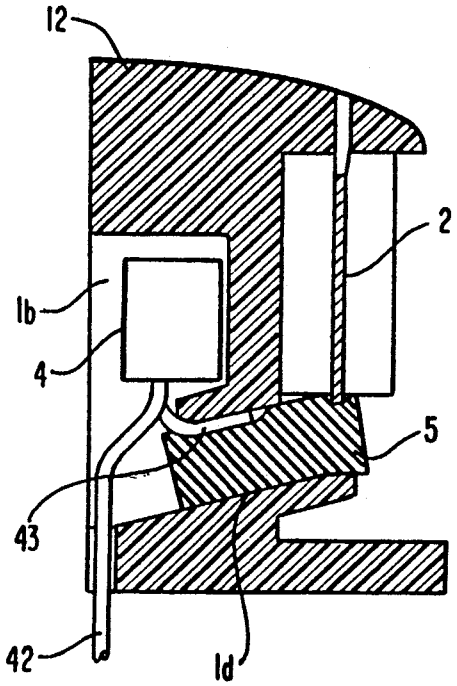
FIG. 5 is a sectional view of the insulation carrier of FIG. 3 taken along the line V—V in FIG. 4.
Figure 4:
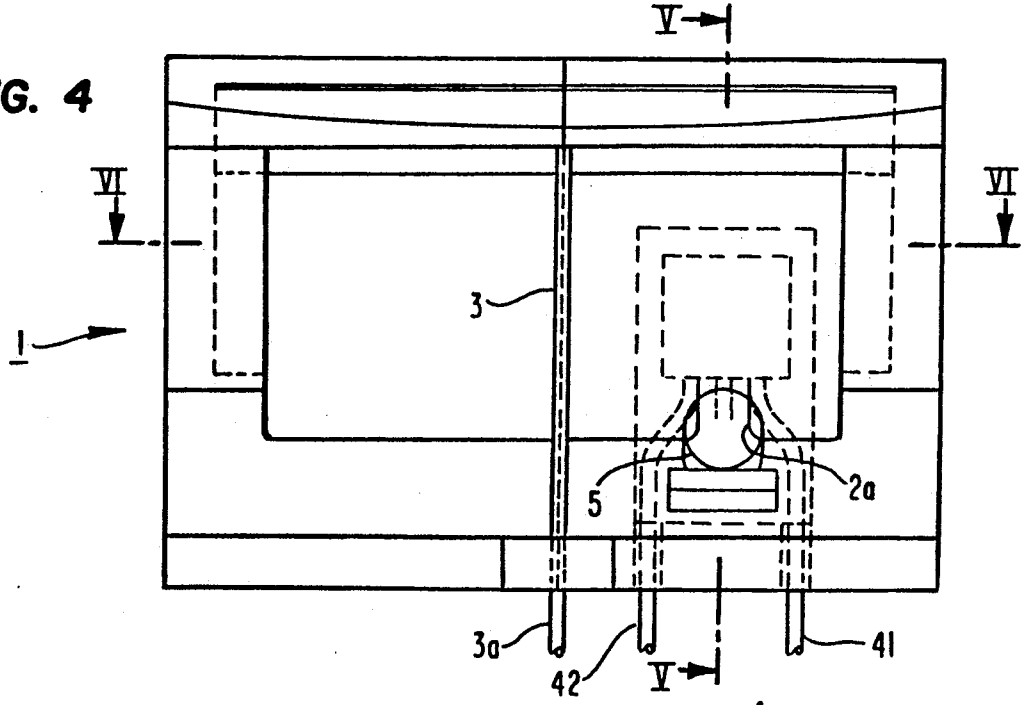
FIG. 4 is a frontal view of an ionization fire detector according to the invention, illustration in detail another embodiment of an insulation carrier including an arrangement of electrode and field-effect carrier.
Figure 6:
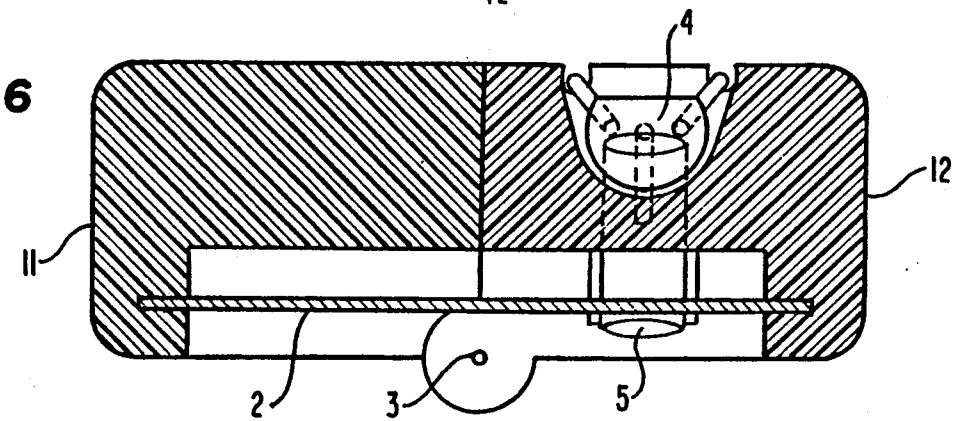
FIG. 6 is a sectional view of the insulation carrier of FIG. 3 taken along the line VI—VI in FIG. 4.

Turning now to FIGS. 4–6 there is shown another embodiment of an insulation carrier 1 of an ionization fire detector according to the invention. In contrast to the previous embodiment as shown in FIGS. 1–3, the cavity 1*b* of the insulation carrier 1 is open toward the rear of the insulation carrier 1, as shown in particular in FIGS. 5 and 6. Thus, for installation of the field-effect transistor 4 in cavity 1*b*, the insulation carrier 1 does not have to parted into two halves 11 and 12 as indicated in FIGS. 4 and 6 since the FET 4 can simply be inserted in the cavity 1*b* from the outside. The cavity 1*b* is connected via a bore 1*d* with the front side of the insulation carrier 1 to allow insertion of the profile piece 5 of conductive caoutchouc from the outside. In the nonlimiting example of FIGS. 4–6, the profile piece 5 is of cylindrical cross-section. The respectively shortened and bent gate terminal 43 of the FET 4 is contacted with the perimeter of the profile piece 5 by being clamped between the inside wall surface of the bore 1*d* and the perimeter of the profile piece 5. After installation and suitable securement of the FET 4 within the cavity 1*b*, insulating plastic material may again be injected into the cavity 1*b*.

While the invention has been illustrated and described as embodied in an ionization fire detector, it is not intended to be limited to the details shown since various modifications and structural changes may be made without departing in any way from the spirit of the present invention.

What is claimed as new and desired to be protected by Letters Patent is set forth in the appended claims:

We claim:

1. An ionization fire detector including a measuring chamber and a reference chamber having a common electrode connected to the gate terminal of a field-effect transistor, said ionization detector comprising:

an insulation carrier having a front side supporting said common electrode and a back side provided with a cavity which is separated from said electrode by a wall section and accommodates said field-effect transistor; and a profile piece made of conductive caoutchouc and traversing a bore in said wall section for contacting with one end said gate terminal and with another end said common electrode for providing a connection between said common electrode and said gate terminal and allowing insulation of said field-effect transistor from said electrode, said profile piece being dimensioned to form a low pass filter comprised of a high resistance series resistor represented by said profile piece and unavoidable capacitances.

2. An ionization fire detector as defined in claim 1 wherein said gate terminal is embedded within said one end of said profile piece.

3. An ionization fire detector as defined in claim 1 wherein said gate terminal is positioned between an inside wall of said insulation carrier and the perimeter of said one end of said profile piece for contact with said profile piece.

4. An ionization fire detector as defined in claim 1 wherein said other end of said profile piece bears elastically against said common electrode.

5. An ionization fire detector as defined in claim 1 wherein said common electrode has a recess for cutting into said other end of said profile piece when inserting said profile piece in said insulation carrier.

6. An ionization fire detector as defined in claim 1 wherein said field-effect transistor is secured within said cavity by casting.

* * * * *